US005487431A

United States Patent [19]

Webb

[11] Patent Number: 5,487,431

[45] Date of Patent: Jan. 30, 1996

[54] SUBTERRANEAN FLUID SAMPLING SYSTEMS AND METHODS

[75] Inventor: David E. Webb, Vero Beach, Fla.

[73] Assignee: Drilling Services, Inc., Ft. Pierce, Fla.

[21] Appl. No.: 262,688

[22] Filed: Jun. 20, 1994

[51] Int. Cl.[6] ..... E21B 7/26

[52] U.S. Cl. ..... 175/20; 175/58; 175/232

[58] Field of Search ..... 175/19–21, 232, 175/58, 325.2, 325.5, 325.6

[56] References Cited

U.S. PATENT DOCUMENTS

| | | | |
|---|---|---|---|
| 1,211,415 | 1/1917 | Cross | 175/22 |
| 4,310,057 | 1/1982 | Brame | 175/21 |
| 4,669,554 | 6/1987 | Cordry | 175/59 |
| 4,804,050 | 2/1989 | Kerfoot | 175/20 |
| 4,807,707 | 2/1989 | Handley et al. | 175/20 |
| 5,046,568 | 9/1991 | Cordry | 175/21 |

*Primary Examiner*—Roger J. Schoeppel
*Attorney, Agent, or Firm*—Carroll F. Palmer

[57] ABSTRACT

A subterranean sampling system of the direct push type that employes an elongated push tube in combination with hydraulic means to force the push tube down through subterranean strata includes an improved sampler unit which basically includes a sample retaining cylinder surrounding an elongated slotted tube with a pierce member at the distal end and, at the proximal end, a tube guide member plus an adapter unit by which the sampler unit is connected to the lower end of the push tube. The system enables a new fluid sampling method in which the sampler unit is manipulated by the push tube into three modes. In the first mode, the slotted tube is within the cylinder so none of its slots extend proximally of the cylinder and no ambient fluid can enter. In the second mode, the slotted tube is moved out of the cylinder so only some of its slots extend proximally of the cylinder whereby ambient fluid may enter the cylinder. In the third mode, all of slots of the slotted tube extend proximally of cylinder and no ambient fluid may again enter the cylinder. Ultimately, the sampler unit is withdrawn from the strata without again permitting any of the tube slots to extend distally of the cylinder and a valid fluid sample is recovered. The system may also be used to pump out large samples of strata water or gas and the sampler unit may be used in a reverse mode to collect samples on the top of rock layers that prevent penetration by the push tube.

2 Claims, 4 Drawing Sheets

SUBTERRANEAN FLUID SAMPLING SYSTEMS AND METHODS

BACKGROUND OF THE INVENTION

1. Field of the Invention

This application relates to improved subterranean fluid sampling systems and improved subterranean fluid sampling methods. More particularly, it concerns such systems and methods based on direct push technology.

2. Description of the Prior Art

The sampling of subterranean waters or other fluids is required for a variety of reasons, investigation of ground water contaminant plumes being a current major demand for such sampling operations.

Subterranean sampling is an ancient, highly developed art that involves a wide variety of equipment and procedures. A recent addition is direct push technology (DPT) in which desired data and/or samples from subterranean locations are obtained by instruments that are physically forced into the soil to penetrate it to precise testing depths. A prime example is cone penetrometer testing for determining soil types, consistency and density used for developing footing and pile foundation design criteria.

Typically, DPT comprises the hydraulic forcing of a push rod tipped with a pointed test member into the soil to the required depth. In testing for and obtaining samples of ground water or other fluids, DPT has been employed and "HYDROPUNCH" equipment has been developed using DPT (see *Ground Water Management Review,* Spring 1991, p. 101–106).

The present invention further advances the art of ground fluid sampling using direct push technology.

Ground water contamination and other environmental concerns about subterranian strata have placed new demands on existing technology for the sampling of subterranean waters or other fluids. For example, such sampling now requires that the acquired fluid sample be precisely confined to stratum from which it is designated to have been obtained. This may seem an obvious requirement, but prior known sampling methods often have resulted in samples contaiminated with fluids existing in strata other than the one designated, e.g., fluids encountered by the sampling device while reaching the datum stratum. Moreover, in order to meet this requirement using existing equipment, time consuming operations have been used that result in expensive additional labor costs, e.g., washing of push rod sections as they are withdrawn during retrevial of the desired sample.

Another problem encountered with known subterranean fluid sampling methods and apparatus is their failure to maintain the full sample volume as the sampling equipment is recovered for the subterranean site. Thus, deficiencies in such operations frequently result in major portions of the acquired sample being lost by leakage as the sampling equipment is retrieved.

The present invention addresses these known problems of prior subterranean fluid sampling methods and apparatus and provides unique solutions therefor.

OBJECTS

A principal object of this invention is the provision of an improved subterranean fluid sampling system using direct push technology.

Another object is the provision of an improved subterranean fluid sampling method using direct push technology.

Further objects include the provision of such new systems and methods that:

1. Do not require any appreciable hydrostatic head above a sampling port in order to obtain suitable water samples.

2. Consistently obtain samples without any contamination from non-sampled strata or otherwise.

3. Reliably obtain the necessary water samples at the prescribed depth by avoiding malfunctions or partial sample collection.

4. Seal and isolate water samples by slide valve action and avoid the chance of additional water entering the system.

5. Can be reversed to collect samples at layers of hard strata, e.g., rock.

6. Can pump out large quantities of sample through the assembly.

7. Can pump out gas samples through the assembly.

Other objects and further scope of applicability of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The objects are accomplished, in part, in accordance with the invention by the provision of a subterranean sampling system of the direct push type that typically employes an elongated push tube having a tool connector lower end in combination with hydraulic means to force the push tube downwardly through subterranean strata.

The improved sampling system of the invention comprises an improved sampler unit which basically comprises a sample retaining cylinder provided with a pierce member and interconnected with a guide member, an elongated slotted tube and an adapter unit by which the sampler unit is connected to the lower end of the push tube.

The cylinder is defined by a first end portion, a second end portion and a tubular body portion integrally joining the first and second end portions. In a preferred embodiment, it is internally threaded at both ends to connect distally to the pierce member and proximally to the guide member.

The pierce member has a pointed distal end portion and a proximal end portion in fluid tight connection with the first end portion of the cylinder.

The guide member is defined by a first end section having an inlet terminus through which a central bore extends, a second end section in fluid tight connection with the cylinder second end portion and a longitudinal conduit extending from the central bore through the second end section.

The elongated tube is defined by an external wall of diameter less than the inside diameter of the cylinder, an internal wall, a closed end part, an open end part and a longitudinal body part joining the closed end part to the open end part. Its body part has a plurality of spaced apart slots extending radially through its external and internal walls. This slotted tube is slidingly received in the central bore of the guide member that contains sealing means to prevent fluid passing into the cylinder via the inlet terminus of the guide member.

The adapter unit has a proximal portion in fluid tight connection with the tool connector lower end of the push tube and a distal portion in fluid tight connection with the open end part of the elongated tube, but it is unconnected to the guide member or the cylinder.

The sampler unit additionally comprises a modified adapter unit and a modified pierce unit to permit the remainder of the unit to be used in an inverted mode that permits the modified unit to collect fluid samples close to the top of an impenetrable strata, e.g., a layer of rock.

The objects of the invention are further provided by an improved direct push type method of sampling subterranean fluids using an elongated push tube and hydraulic means to force the push tube downwardly through subterranean strata.

The new method involves a unique combination of steps which comprise (a) providing a collection cylinder containing a longitudinal bore and being defined by a pointed distal terminus and a proximal terminus disconnected from and positioned below the push tube, (b) providing an elongated tube carried by the push tube and defined by an open proximal end, a closed distal end and an external wall slideably mounted within the cylinder proximal terminus, the elongated tube having a plurality of slots extending into its interior through the external wall spaced apart from each other and the proximal and distal ends, (c) preventing subterranean fluid from entering the cylinder except via the slotted tube, (d) initially positioning the slotted tube so none of the slots extend proximally of the proximal terminus whereby no subterranean fluid may enter the cylinder, (e) later positioning the slotted tube so only some of the slots extend proximally of the proximal terminus whereby subterranean fluid may enter the cylinder, (f) thereafter positioning the slotted tube so all of the slots extend proximally of the proximal terminus whereby subterranean fluid may again no longer enter the cylinder, and (g) ultimately withdrawing the cylinder from the subterranean strata without again permitting any of the slots of the slotted tube to extend distally of the proximal terminus.

BRIEF DESCRIPTION OF THE DRAWINGS

A more complete understanding of the invention can be obtained by reference to the accompanying drawings in which.

DESCRIPTION OF THE PREFERRED EMBODIMENTS

Figure 1:
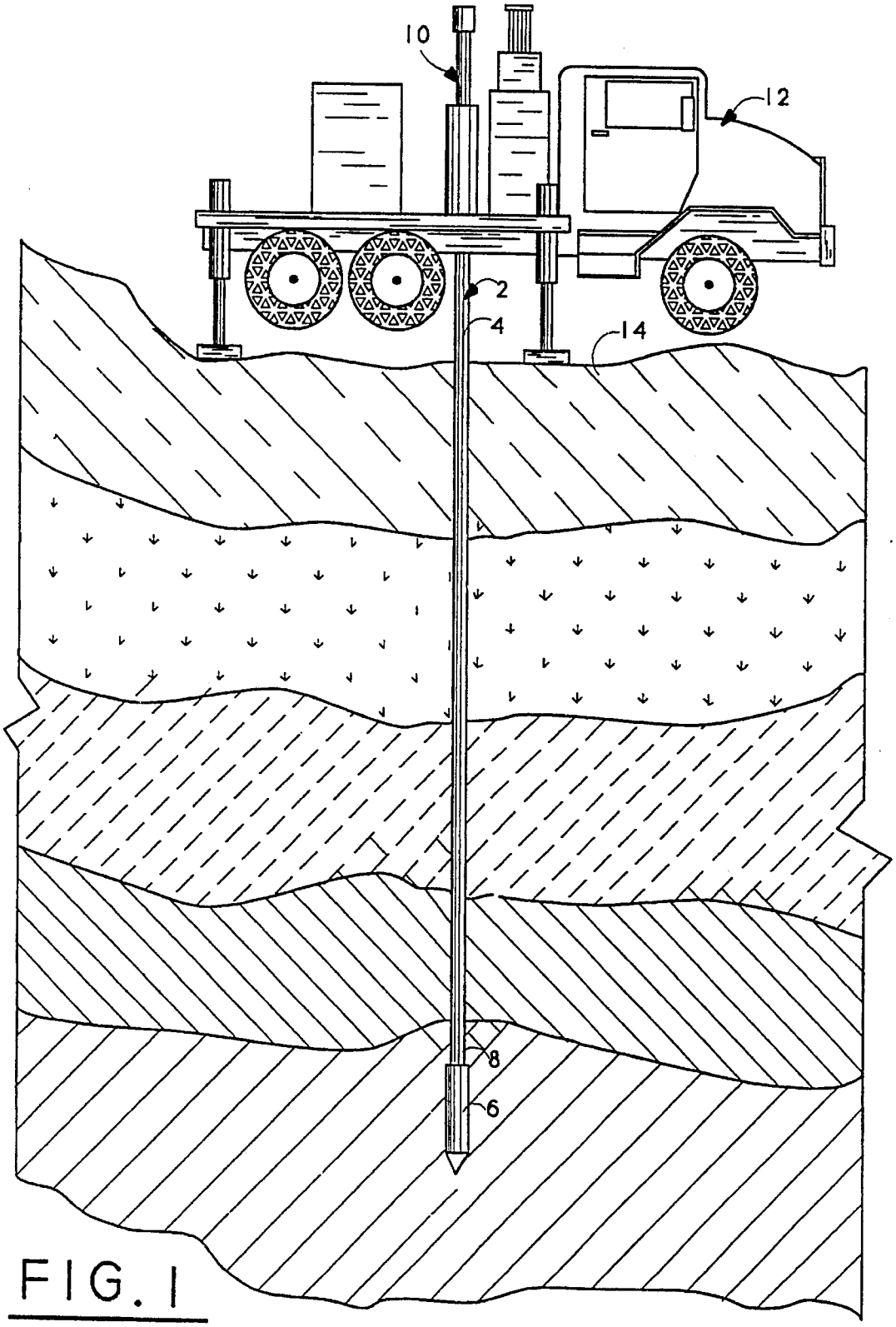
FIG. 1 is a diagrammatic illustration of a subterranean sampling system of the invention being operated to obtain a water sample in accordance with a method of the invention.

A subterranean sampling system 2 of the invention of the direct push type employes an elongated push tube 4 having a tool 6 connector lower end 8 in combination with hydraulic means 10 mounted on a truck 12 to force the push tube 4 downwardly through subterranean strata 14.

The improved sampling system 2 comprises a unique sampler unit 16 which basically comprises a sample retaining cylinder 18 provided with a pierce member 20 and interconnected with a guide member 22, an elongated slotted tube 24 and an adapter unit 26 by which the sampler unit 16 is connected to the lower end 8 of the push tube 4.

Figures 10, 11, 12, 13, 14, 15, 16, 17, 18, 19, 20, 21:
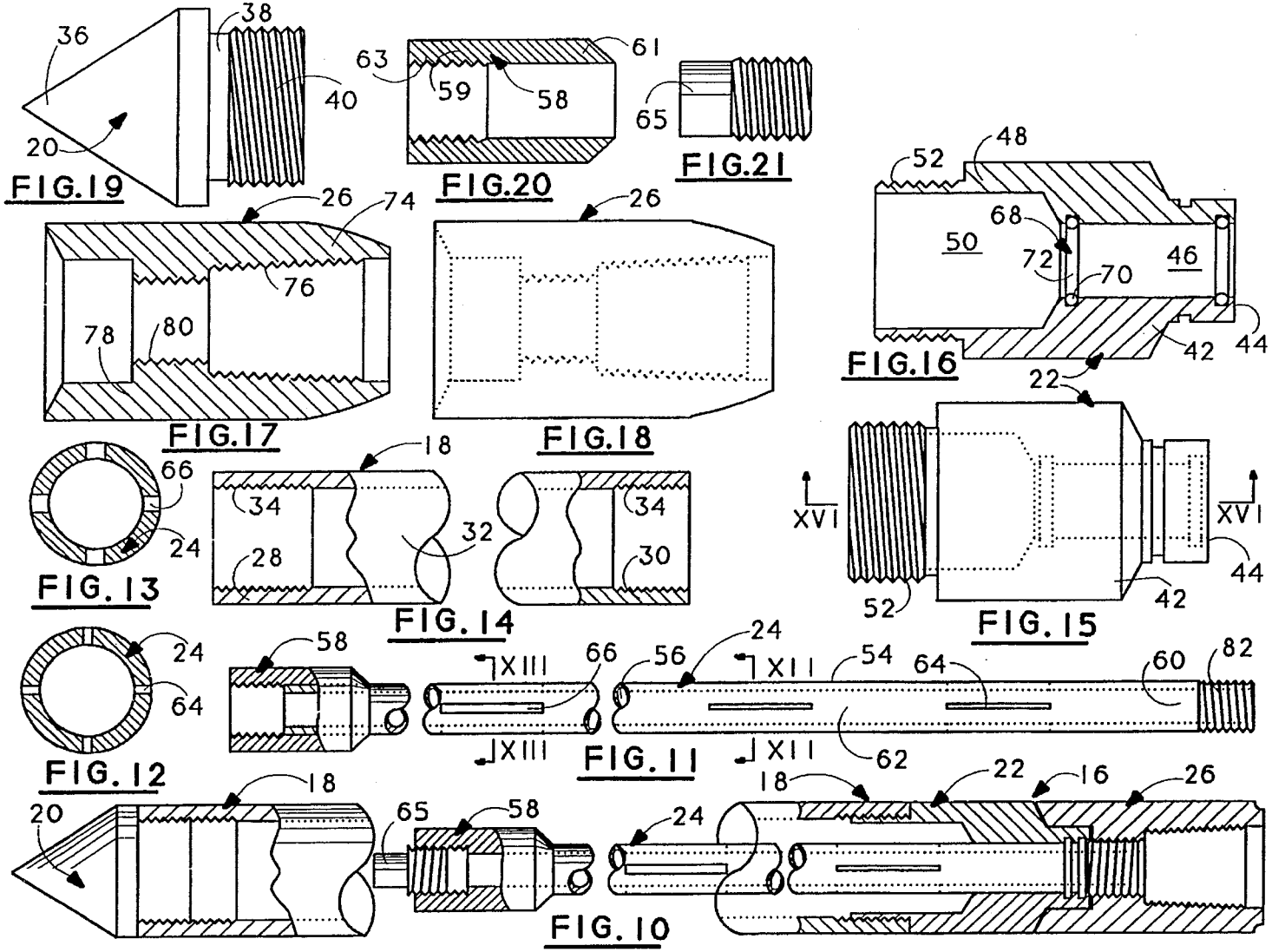
FIG. 10 is a lateral, partially fragmented and partially sectioned view of a preferred embodiment of a sampler unit of the invention.
FIG. 11 is fragmentary, partially sectioned plan view of an internal portion of the sampler unit of FIG. 10.
FIG. 12 is a sectional view taken on the line XII—XII of FIG. 11.
FIG. 13 is a sectional view taken on the line XIII—XIII of FIG. 11.
FIG. 14 is an enlarged, fragmentary, partially sectioned plan view of the cylinder of the sampler unit of FIG. 10.
FIG. 15 is an enlarged plan view of the guide member of the sampler unit of FIG. 10.
FIG. 16 is a sectional view taken on the line XVI—XVI of FIG. 15.
FIG. 17 is an enlarged sectional view of the push rod adapter of the sampler unit of FIG. 10.
FIG. 18 is an enlarged plan view of the push rod adapter of the sampler unit of FIG. 10.
FIG. 19 is an enlarged plan view of the pierce member of the sampler unit of FIG. 10.
FIG. 20 is an enlarged sectional view of the screen tube stop member of the sampler unit of FIG. 10.
FIG. 21 is an enlarged plan view of the screen tube stop member of the sampler unit of FIG. 10.

The cylinder 18 is defined by a first end portion 28, a second end portion 30 and a tubular body portion 32 integrally joining the first and second end portions. In the preferred embodiment of FIG. 10, the cylinder 18 has internal threads 34 at both ends to connect distally to the pierce member 20 and proximally to the guide member 22.

Bayonet or other type connections may be substituted for the threads.

The pierce member 20 has a pointed distal end portion 36 and a proximal end portion 38 in fluid tight connection with the first end portion of the cylinder. In the preferred embodiment, the proximal end portion 38 has external threads 40 to connect with the first end portion 28 of the cylinder 18.

The guide member 22 is defined by a first end section 42 having an inlet terminus 44 through which a central bore 46 extends, a second end section 48 in fluid tight connection with the cylinder second end portion 30 and a longitudinal conduit 50 extending from the central bore 46 through the second end section 48. In the preferred embodiment, the section 48 has external threads 52 to connect with the second end portion 30 of the cylinder 18.

The elongated tube 24 is defined by an external wall 54 of diameter less than the inside diameter of the cylinder 18, an internal wall 56, a closed end part 58, an open end part 60 and a longitudinal body part 62 joining the closed end part to the open end part. Its body part 62 has a plurality of spaced apart slots 64 & 66 extending radially through its external and internal walls. Preferrably, the slots 66 have a greater area and are lesser in number than the slots 66.

In the preferred embodiment, the closed end part 58 of said elongated tube 24 comprises a concentric collar 59 defined by a proximal end 61 fixed to said tube 24 and distal end 63 closed by a threaded plug 65. Other closure arrangements can be used, e.g., welding (not shown).

The slotted tube 24 is slidingly received in the central bore 46 of the guide member 22 that contains sealing means 68 to prevent fluid passing into the cylinder 18 via the inlet terminus 44. Preferrably, the sealing means 68 comprises radial channels 70 and O-rings 72.

The adapter unit 26 has a tapered proximal portion 74 having internal threads 76 for fluid tight connection with the tool connector lower end 8 of the push tube 4. Unit 26 also has a distal portion 78 having internal threads 80 fluid tight connection with the external threads 82 on the open end part 60 of the elongated tube 24, but unit 26 is unconnected to the guide member 22 or the cylinder 18.

Figure 22:
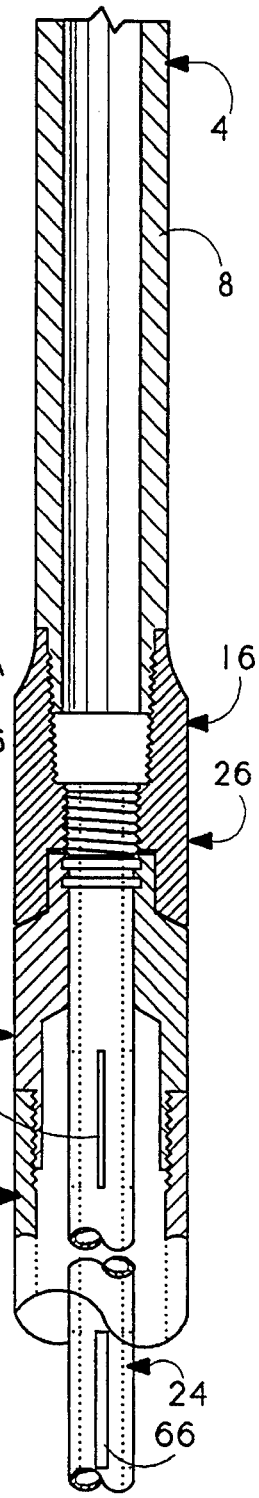
FIG. 22 is an enlarged sectional view of a first embodiment of the proximal end portion of the sampler unit of the invention and the associated lower end of the push tube.

FIG. 22 shows an enlarged view of the proximal portion of a first embodiment of sampler unit 16 (compare with FIG. 10) connected to the lower end 8 of the push rod 4.

Figure 23:
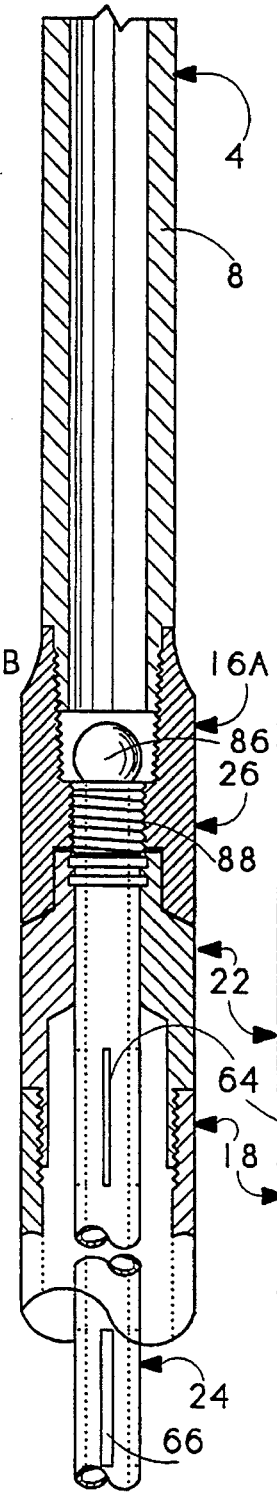
FIG. 23 is an enlarged sectional view of a second embodiment of the proximal end portion of the sampler unit of the invention and the associated lower end of the push tube.

FIG. 23 shows an enlarged view of the proximal portion of a second embodiment of sampler unit 16A connected to the lower end 8 of the push rod 4. This embodiment differs from unit 16 by the presence of the ball 86 which, in cooperation with the proximal end 88 of tube 24, acts as a check value to prevent any fluid that might enter the system 2 via joints in the sections (not shown) of the push tube 4 from flowing and mixing with the fluid sample collected in the cylinder 18.

Figure 24:
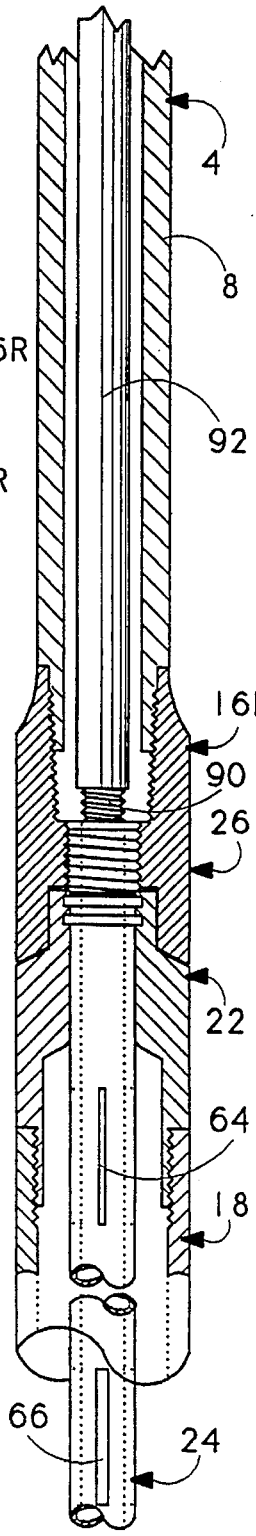
FIG. 24 is an enlarged sectional view of a third embodiment of the proximal end portion of the sampler unit of the invention and the associated lower end of the push tube.

FIG. 24 shows an enlarged view of the proximal portion of a third embodiment of sampler unit 16B connected to the lower end 8 of the push rod 4. This embodiment differs from unit 16 by the presence of the close nipple 90 that connects the tube 24 with the auxiliary tube 92 that extends up through the push tube 4 to the surface to enable a stream of fluid, typically gas, to be sampled from the stratum in which the sampling unit 16B is located.

Figures 2, 3, 4, 5, 6, 7, 8, 9:
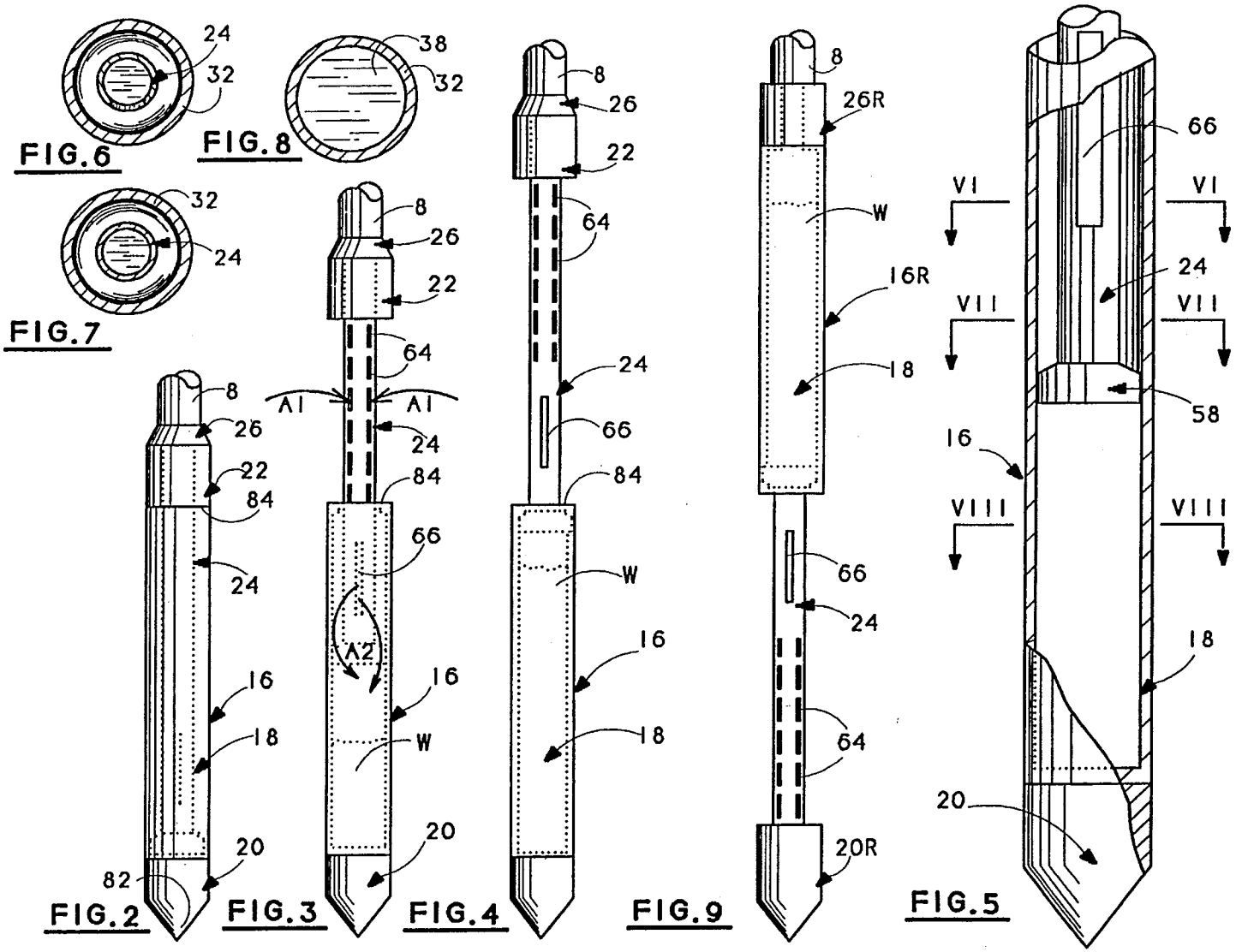
FIG. 2 is a lateral view of a sampler unit in a fully dosed mode of operation in accordance with the invention.
FIG. 3 is a lateral view of the sampler unit in a partially opened mode of operation in accordance with the invention.
FIG. 4 is a lateral view of the sampler unit in the fully opened mode of operation in accordance with the invention.
FIG. 5 is an enlarged, lateral, fragmentary sectional view of the lower portion of the sampler unit shown in FIG. 3.
FIG. 6 is a sectional view taken on the line VI—VI of FIG. 5.
FIG. 7 is a sectional view taken on the line VII—VII of FIG. 5.
FIG. 8 is a sectional view taken on the line VIII—VIII of FIG. 5.
FIG. 9 is a lateral view of the sampler unit assembled with portions in a reversed position and in the fully opened mode of operation in accordance with the invention.
Figure 25:
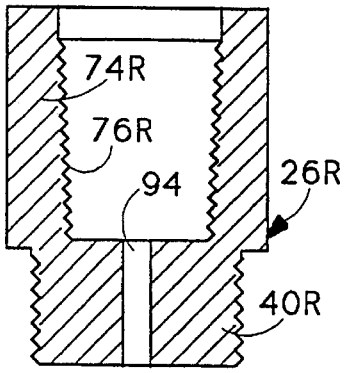
FIG. 25 is a lateral sectional view of a modified adapter unit used with other portions of the sampler unit in reversed position to collect samples at the top of an impenetrable strata.
Figure 26:
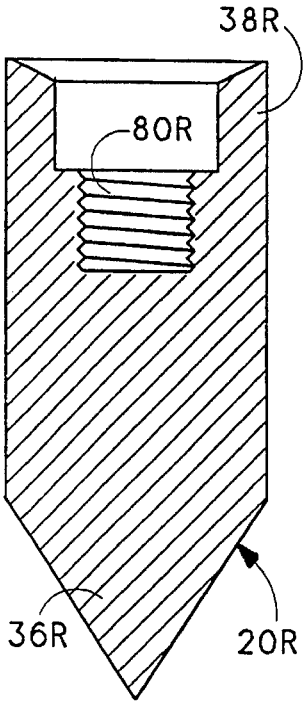
FIG. 26 is a lateral sectional view of a modified pierce member used with other portions of the sampler unit in reversed position to collect samples at the top of an impenetrable strata.

FIGS. 25 & 26 together with FIG. 9 illustrate a reverse mode of operation of the sampler unit 16R in which the cylinder 18, guide member 22 and slotted tube 24 are the same as in the other mode of unit 16, e.g., see FIG. 4, but wherein modified pierce member 20R and modified adapter unit 26R are employed. In this arrangement, the adapter unit 26R enables the cylinder 18 to be reversed for attachment to the end 8 of the push tube 4 so that the slotted tube 24 slides downward out of the cylinder 18 in the collection of a fluid sample rather that upward as in the case shown in FIG. 4. The reverse mode unit 16R is used to collect fluid samples right off the top of an impenetrable stratum (not shown).

The adapter unit 26R has a tapered proximal portion 74R with tapered threads 76R for connection to the tube end 8 and external threads 40R to connect with the end portion 28 of the cylinder 18. A small bore 94 is provided for pressure relief in the cylinder 18 when it fills with a fluid sample.

The pierce unit 20R has a pointed distal end portion 36R and a proximal end portion 38R containing internal threads 80R for fluid tight connection with the external threads 82 of the slotted tube 24.

The objects of the invention are further provided by an improved direct push type method of sampling subterranean fluids involving a unique combination of steps made possible by the provision of the sampler unit 16.

Initially, the sampling method involves forcing the push rod 4 by the hydraulic means 10 into the strata 14 as shown in FIG. 1 until the sampler unit 16 reaches a desired depth. During decent through the strata 14 and up to this point, the sampler unit will be oriented in a first mode as shown in FIG. 2 with the collection cylinder 18 and its pointed distal terminus 82 plus proximal terminus 84 disconnected from and positioned below the push tube 8 while the elongated tube 24 is carried by the push tube via the adapter 26 slideably mounted within the cylinder proximal terminus 84 so all the slots 64 & 66 of the tube are shut off by the guide member 22 and cylinder 16 from the strata 14. In this first mode, none of the slots 64 or 66 extend proximally of the proximal terminus 84 whereby no subterranean water may enter the cylinder 16.

The sampler unit 16 is then manipulated into a second mode shown in FIG. 3 by controlled retraction of the push tube 4 to position the slotted tube 24 so only the slots 64 extend proximally of the proximal terminus 84 whereby subterranean water W may enter the cylinder 18 by flowing into the slots 64 (shown by arrows A1) and out of slots 66 (shown by arrow A2) and into the interior of cylinder 18.

Next, the sampler unit 16 is manipulated into a third mode shown in FIG. 4 by further controlled retraction of the push tube 4 to position the slotted tube 24 so all of the slots 64 & 66 extend proximally of the proximal terminus 84 whereby subterranean fluid may again no longer enter the cylinder 18.

Ultimately, the sampler unit 16 is withdrawn from the subterranean strata 14 (not shown) without again permitting any of the slots 64 & 66 of the slotted tube 24 to extend distally of the proximal terminus 84.

The sampler unit 16A operation mimics that of unit 16 except that the ball 86 serves as a safety feature to prevent any liquid that may enter the system 2 above the end 88 of tube 24 from entering the cylinder 18 and contaminate any sample contained therein.

The sampler unit 16B operation is generally like that of unit 16 except that it is used typically to collect a relatively large sample of gas or liquid from a stratum. Thus, when the unit 16 is manipulated into the fluid inlet mode as shown in FIG. 3, instead of liquid collecting in the cylinder 18, the gas can flow through the slots 64 and the nipple 90 into the tube 92 for surface recovery. Normally, a pump will be used to draw the gas or liquid from the stratum unless the stratum pressure is sufficient to force such fluid up and out the tube 92 without an assist from a pump.

The embodiment of the invention in which an exclusive property or privilege is claimed are defined as follows:

1. In a subterranean sampling system of the direct push type comprising an elongated push tube having a tool connector lower end and hydraulic means to force said push tube downwardly through subterranean strata, an improved sampler unit connected to said lower end which comprises:

a cylinder defining a fluid sample retention space, said cylinder comprising a first end portion and a second end portion, a pierce member defined by a pointed distal end portion and a proximal end portion in fluid tight connection with said first end portion of said cylinder, guide means comprising a first end inlet terminus through which a central bore extends, a second end fluid tight connection with said cylinder second end portion and a longitudinal conduit extending from said central bore to said second end fluid tight connection, an elongated tube defined by an external wall, an internal wall, a closed end part, an open end part and a longitudinal body part joining said closed end part to said open end part, said body part having a plurality of spaced apart slots extending radially through said external and internal walls, said elongated tube being slideably received in said central bore of said guide means to prevent fluid passage between said external wall and said central bore, and means providing a fluid tight connection between said push tube and said open end part of said elongated tube, but unconnected to said guide means or said cylinder whereby said elongated tube may first be moved partially out of said cylinder to position less than all of said plurality of spaced apart slots outside said cylinder thereby permitting and thereafter positioning all of said spaced apart slots outside said cylinder thereby preventing fluid to flow from said strata into said cylinder.

2. In a direct push type method of sampling subterranean fluids using an elongated push tube and hydraulic means to force said push tube downwardly through subterranean strata, a combination of steps which comprise:

providing a collection cylinder defined by a pointed distal terminus and a proximal terminus disconnected from and positioned below said push tube, providing an elongated tube carried by said push tube and defined by an open proximal end, a closed distal end and a external wall slideably mounted within said cylinder proximal terminus, said elongated tube having a plurality of slots extending into its interior through said external wall spaced apart from each other and said proximal and distal ends, preventing subterranean fluid from entering said cylinder except via said slots of said elongated tube, initially positioning said elongated tube relative to said cylinder so none of said slots extend proximally of said proximal terminus whereby no subterranean fluid may enter said cylinder, later positioning said elongated tube relative to said cylinder so only some of said slots extend proximally of said proximal terminus whereby subterranean fluid may enter said cylinder, thereafter positioning said elongated tube relative to said cylinder so all of said slots extend proximally of said proximal terminus whereby subterranean fluid may again no longer enter said cylinder, and ultimately withdrawing said cylinder from said subterranean strata without again permitting any of said slots of said slotted tube to extend distally of said proximal terminus.

* * * * *